United States Patent [19]

Madigan

[11] Patent Number: 4,879,881

[45] Date of Patent: Nov. 14, 1989

[54] ENERGY EFFICIENT FROST-FREE REFRIGERATOR

[76] Inventor: Stephen M. Madigan, 10 Crestmont Rd., Montclair, N.J. 07042

[21] Appl. No.: 246,151

[22] Filed: Sep. 19, 1988

[51] Int. Cl.[4] ..... F25D 11/02

[52] U.S. Cl. ..... 62/447; 165/129

[58] Field of Search ..... 62/441, 447; 165/129

[56] References Cited

U.S. PATENT DOCUMENTS

| | | | |
|---|---|---|---|
| 1,698,592 | 1/1929 | Hill | 62/246 |
| 1,926,718 | 9/1933 | Fredberg | 62/441 |
| 2,178,511 | 10/1939 | Kucher | 62/441 X |
| 2,242,407 | 5/1941 | Tobey | 62/441 |
| 2,292,032 | 8/1942 | Atchison | 62/441 X |
| 2,306,480 | 12/1942 | Ketcham | 62/447 X |
| 2,430,110 | 11/1947 | De Vilbiss | 62/447 X |
| 2,572,715 | 10/1951 | Gallaugher | 62/447 X |
| 2,728,203 | 12/1955 | King | 62/447 X |
| 2,801,525 | 8/1957 | Bixler | 62/447 |
| 3,025,683 | 3/1962 | Baker et al. | 62/441 X |
| 3,135,102 | 6/1964 | Ullstrand | 165/129 X |
| 4,241,589 | 12/1980 | Grumm et al. | 62/441 X |

*Primary Examiner*—William E. Tapolcai

*Attorney, Agent, or Firm*—Auslander & Thomas

[57] ABSTRACT

An energy efficient frost free refrigerator having a cooling compartment a freezing compartment and a single refrigerating element is defrostable during refrigeration off cycles by the circulation of air within the refrigerator. The refrigerating element is physically located above the freezing compartment. Defrost of the refrigerator is accomplished without objectionable defrost of what is in the freezing compartment and without the need to introduce generated heat to effect the defrost. The configuration of the elements protects what is frozen within a pool of freezing air, protected against defrost. A circulating fan may be used to implement the process. The configuration of the refrigerator of the present invention enables an economy of energy use and construction cost.

43 Claims, 3 Drawing Sheets

FIG.1
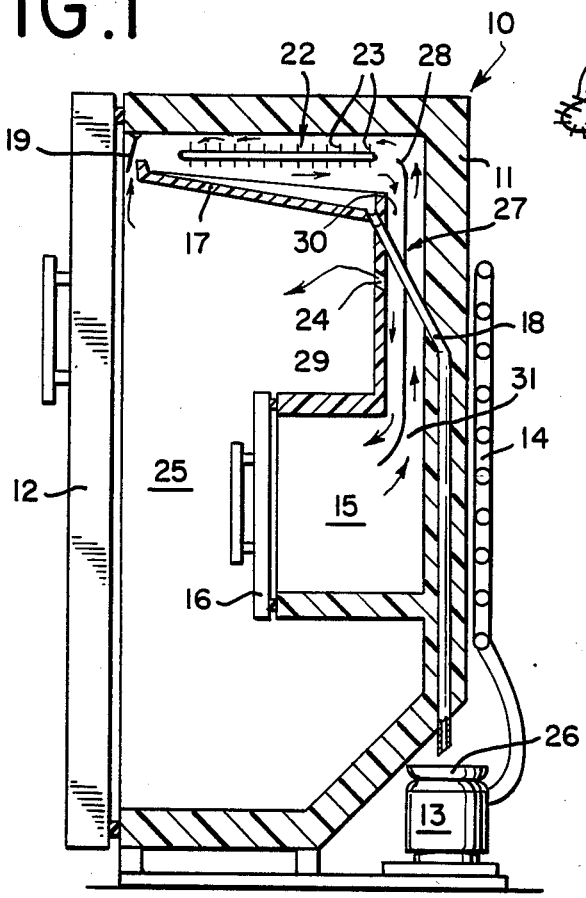
FIG.2
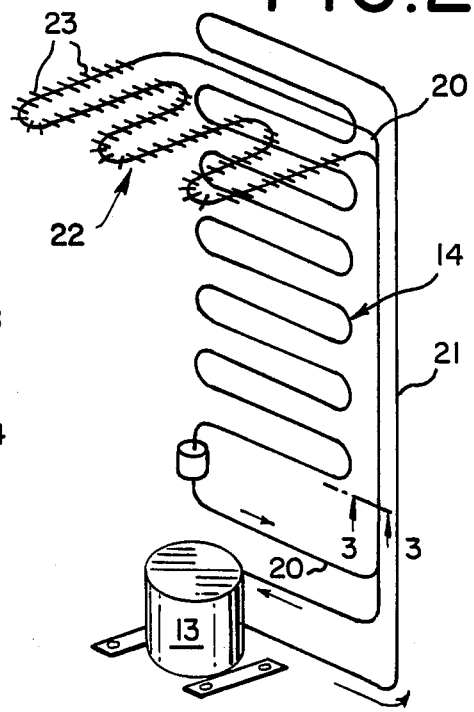
FIG.3
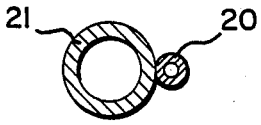
FIG.1a
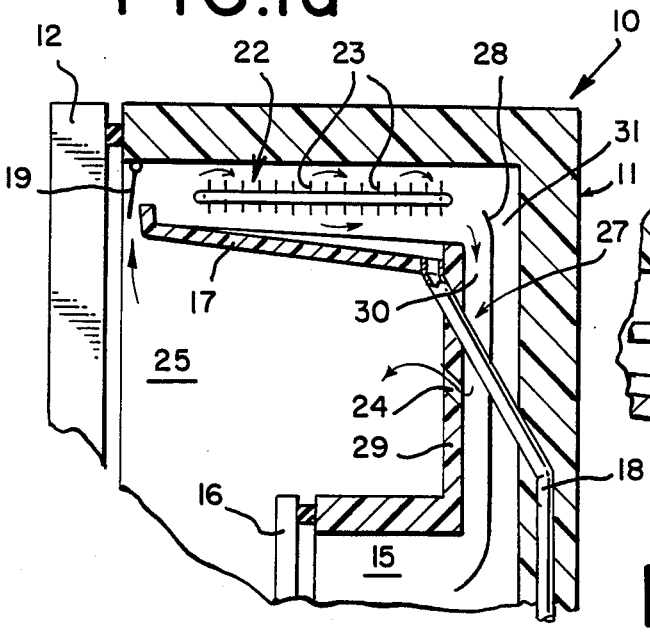
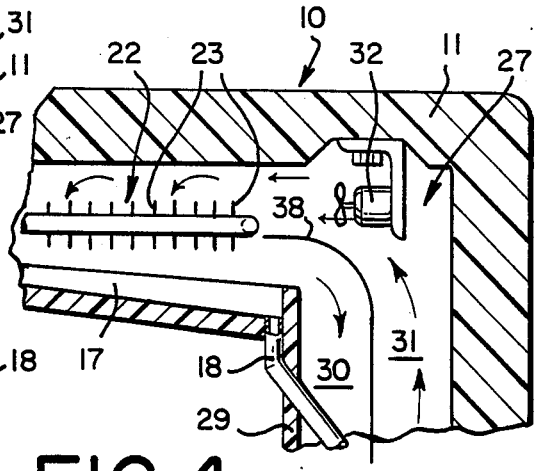
FIG.4

FIG.5
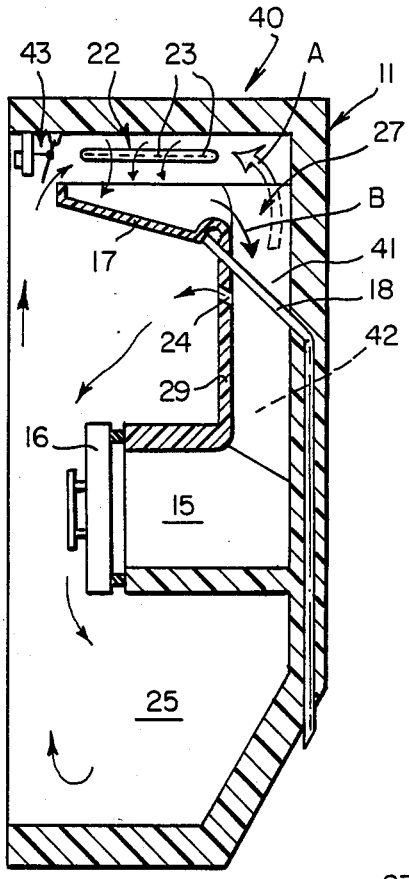
FIG.5a
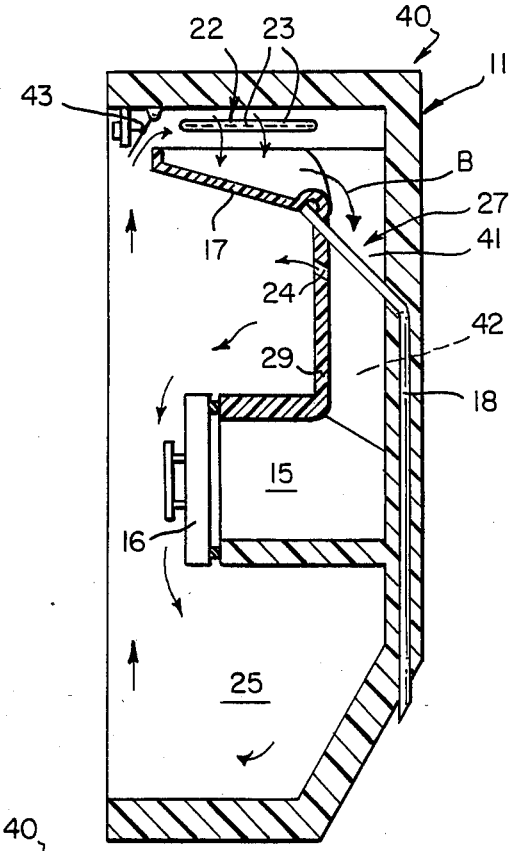
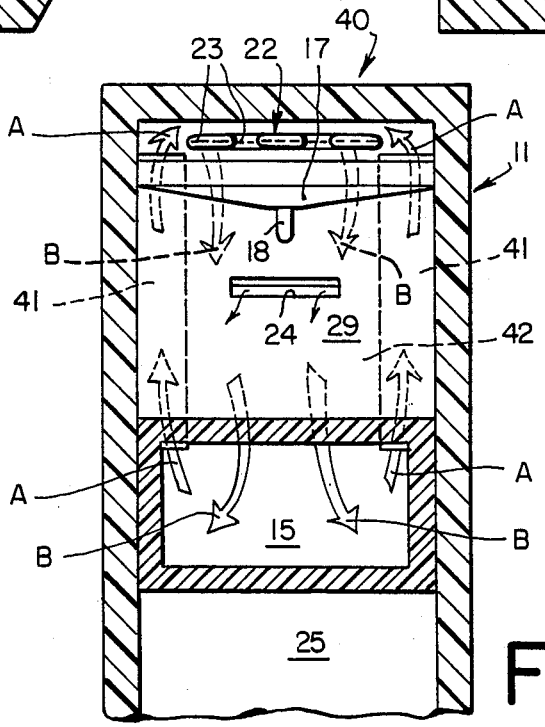
FIG.6

FIG.7
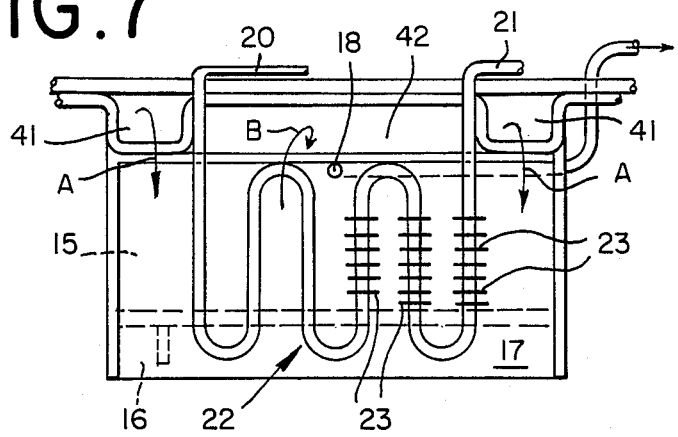
FIG.9
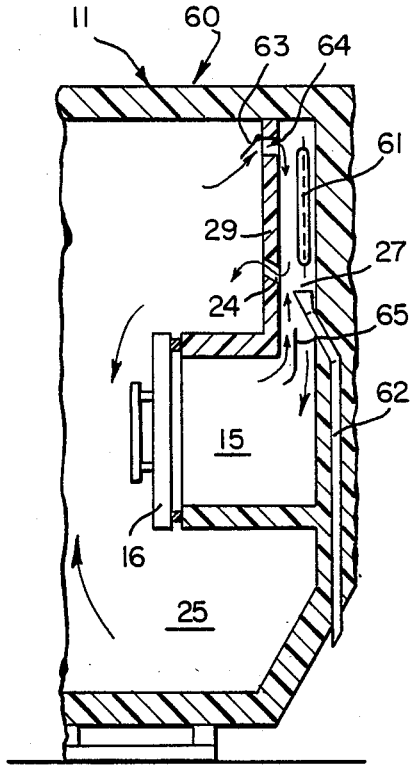
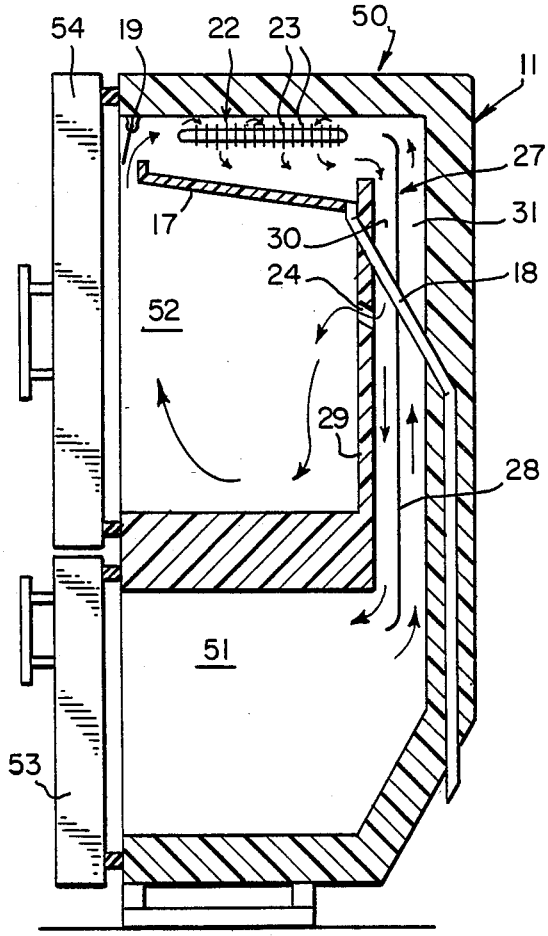
FIG.8
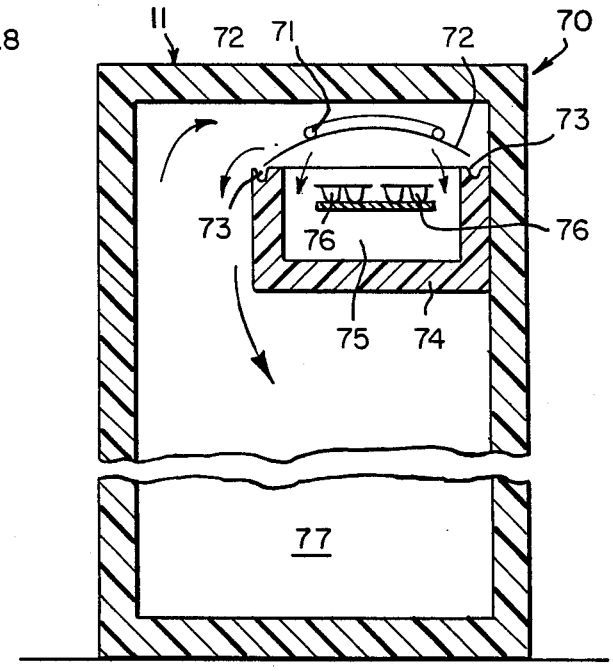
FIG.10

ENERGY EFFICIENT FROST-FREE REFRIGERATOR

This invention relates to a frost-free refrigerator using a single refrigerating element and having a freezing compartment and a cooling compartment.

The present invention self defrosts without the addition of special defrost heat to the system and does so, so that the freezing compartment is not defrosted during the defrost cycle and the cooling compartment temperature is substantially maintained. Air circulation may be regulated by fixed dampers or energy efficient thermostatically operated dampers, controlling the circulation of air for cooling and defrosting. Circulating fans ma also be used.

The dampers in the refrigerator of the present invention are located in the warmed air flow portion of the refrigerator, obviating the prior art problem of possible damper freezing.

BACKGROUND OF THE INVENTION

There are generally three types of refrigerators having freezing and cooling compartments. There is the conventional one-door refrigerator with the freezing compartment within the body of the refrigerator, the conventional cycle defrost refrigerator, where the freezing compartment is separated and automatic defrost is effectuated only in the cooling chamber and a frost-free refrigerator having two compartments, where both compartments are automatically defrosted.

The frost-free refrigerator is expensive to construct and to operate.

The cycle defrost refrigerator only defrosts the evaporator of the cooling compartment, thus, full defrost of a cycle defrost refrigerator requires a shut down of the refrigerator for an ultimate defrost. The system may also require the addition of heat to properly defrost. The cycle defrost system is inconvenient. The requirement to provide two connected evaporators adds cost to the system.

The conventional frost-free refrigerator requires expensive construction, including heating elements near the freezer doors to make certain that the freezer does not sweat and is never frozen shut. A freezing compartment within a conventional refrigerator does not pose this problem. Defrosting the frost-free refrigerator is also expensive, since it generally requires the application of additional heat in order to remove the frost. The frost must be removed quickly, in order to minimize the warming of the contents of the freezing compartment and warming the contents of the cooling compartment.

The conventional one-door refrigerator with a freezing compartment within the body of the refrigerator may be defrosted by automatic cycle defrost or defrosted by a shut down. The one-door refrigerator with a freezing compartment within the body of the refrigerator has the efficiency advantage of requiring less insulation to protect the freezing compartment and is thereby generally less expensive to construct and somewhat more energy efficient. It has the disadvantage of requiring more frequent defrosting than the freezing compartment in the cycle defrost refrigerator.

Prior art systems for fully automatic cooling and defrosting, generally require extensive fan circulating means to circulate the air within the refrigerator for the purposes of controlling both cooling and freezing compartment and the installation of heaters and expensive wiring to defrost the evaporator and portions of the condensate disposal system. Frost-free systems also require a defrost timer and defrost heater control and associated wiring.

The present invention efficiently defrosts the evaporator within the refrigerator, primarily circulating the air within the refrigerator without need for the addition of the defrosting heat. It does this by circulation of internal air primarily by convection, or with a minimum intervention of fan-blown air.

A distinction of the present invention is a single evaporator element serving a self-defrosting frost-free cooling compartment and freezing compartment in which the evaporator is located above the frozen food chamber. The single evaporator element may be contained in an insulated compartment.

While reference herein will be made to the conventional evaporator and compressor on and off cycles, the present invention is equally applicable to other refrigeration elements and their on and off cycles, independent of refrigeration employing a compressor.

DESCRIPTION OF THE PRIOR ART

U.S. Pat. No. 2,801,525 shows a conventional cycle defrost system with a double evaporator having a portion in the freezer and in the fresh food storage compartment. Defrosting of the two evaporators is achieved by using the warm air in the cooling compartment to heat the refrigerant in the lower portion of the evaporator in a cycle to defrost the freezer portion of the evaporator. The system ostensibly uses a single evaporator for the two compartments but does not use cooled air from a single evaporator for both freezing and refrigerating two different compartments. The refrigerator includes a freezing compartment, cooling compartment and an evaporator of the flooded recirculating type, which maintains both compartments at desired operating temperatures. The automatic defrost is achieved by the refrigerant's absorption of heat from the cooling compartment without effecting subfreezing temperatures to be maintained in the freezing compartment. Circulation mean are maintained within the freezing compartment, circulating the air cooled by the evaporator portion in the freezing compartment Freezing in the freezing chamber is obtained by a fan circulating the air from the second portion of the evaporator into the separated freezing chamber. The evaporator portion itself is not in contact with the frozen contents of the freezing chamber. The defrost is achieved during the compressor off cycle when the fan is not circulating air into the freezing chamber. The warmed refrigerant from the cooling compartment is circulated into the evaporator portion in the freezing chamber and defrost is achieved. The evaporator being separated from the actual freezing chamber protects against defrosting in the freeing chamber itself during this defrost cycle, since the fan circulating the air is inoperative during the defrost cycle. Cooling in the cooling compartment is achieved by convection. When the cooling compartment reaches a predetermined minimum temperature, the fan and compressor go off and the defrost cycle goes on. The patent contemplates the use of auxiliary heating means There is no mixing of freezer and fresh food air, nor any suggestion of a single evaporator element serving both freezing and cooling compartments.

The location of the evaporator at or below the level of the freezing chamber considerably extends the time required to defrost to the extent that the temperature within the freezing compartment is materially effected during the defrost cycle. A convective relationship must be established between the evaporator and the stored frozen food, which must lead to at least some defrost of the outer surface of the frozen food during each defrost cycle from heat from the defrosting evaporator.

Frozen foods under U.S. Pat. No. 2,801,525 must get at least some surface defrost during each defrost cycle since there must be convection from the colder frozen food to the warm defrosting evaporator during each defrost cycle.

U.S. Pat. Nos. 3,248,893 and 3,248,894 disclose the prior art systems, employing a recirculation of cooling compartment air for use in a defrost cycle. The system is dependent upon a complex set of dampers and a fan circulating system, circulating air alternately between a freezing compartment and cooling compartment. The evaporator under this system is physically placed between the freezing compartment and the cooling compartment. The cooling of the freezing compartment requires fan circulation of air from the evaporator, which is below the freezing compartment. The invention is dependent upon a complex structure of carefully monitored, alternately opening and closing dampers combined with complex control to obtain the necessary cycling of air for defrost, without the addition of additional heat, other than heat obtained from air in the cooling compartment.

U.S. Pat. No. 3,077,749 discloses a multi-zone fan operated cooling compartment, wherein different temperatures are maintained in various parts of the cooling compartment, with circulation obtained by a fan blowing over a large evaporator with a complex heat exchange and convection system for achieving the zone cooling. In this system the evaporator defrosts during each cooling cycle. The defrost is only involved with the defrost of a cooling compartment.

U.S. Pat. No. 4,353,223 discloses a two-part evaporator system which would appear to defrost a freezing compartment and a cooling compartment by convective circulation of air. The location of the two portions of the evaporator in a connected air flow relationship, necessarily prolongs any defrost time by cooling the evaporator portion from the cooling compartment. Also, the circulation of the air from the freezer evaporator into the freezer chamber sets up a direct convective relationship between the frozen articles and the evaporator, tending to defrost, as well as lengthening the time for evaporator defrost.

Accordingly, a primary object of the present invention is to provide an energy efficient self-defrosting refrigerator of simple construction.

Another object of the present invention is to provide an energy efficient, simple to construct, refrigerator, that is able t defrost without additional heat energy and without defrosting in the freezing compartment.

Another object of the present invention is to provide a refrigerator with a single refrigerating element located above the freezing compartment.

Another object of the present invention is to provide a refrigerator with a single refrigerating element cooling both the freezing and cooling compartment.

Another object of the present invention is to provide a refrigerator with a freezing compartment and cooling compartment employing a single refrigerating element which circulates the freezing and cooling air streams.

A BRIEF SUMMARY OF THE INVENTION

According to the present invention, a frost-free refrigerator has a single refrigerating element located above the freezing compartment, which serves both the freezing compartment and the cooling compartment. The single refrigerating element is defrosted on the off cycle without any undesirable defrost of the contents of the freezing compartment.

An energy efficient frost free refrigerator with a freezing compartment, a cooling compartment, a single refrigerating element, temperature control means adapted to actuate the refrigerating element to on and off cycles at selected temperatures, has the refrigerating element located above said freezing compartment. There are means to direct air from the refrigerating element to the freezing compartment, from the refrigerating element to the cooling compartment from the freezing compartment to the refrigerating element, and from the cooling compartment to the refrigerating element. The refrigerator may include an evaporator and a compressor as part of its system. Preferably the freezing compartment has a door and is either located in the cooling compartment or it may be separate.

In some embodiments there is at least a channel between the refrigerating element and the freezing compartment including the means to direct air from the refrigerating element to the freezing compartment, from the refrigerating element to the cooling compartment, and from said freezing compartment to the refrigerating element. The channel may include passages. The passages may be defined by a shield which may end within the freezing compartment and which may be curved at its end.

There may be at least one passage in the channel adapted to direct air from the refrigerating element to the freezing compartment and from the freezing compartment to the refrigerating element. Any passage from the freezing compartment to the refrigerating element should preferably end at a level above the a passage from the refrigerating element to the freezing compartment.

The channel should include a slot which preferably is horizontal and which opens into the cooling compartment. The slot preferably includes peripheral edges upsloped toward the cooling compartment. The slot is a means to direct air from the refrigerating element to the cooling compartment through an appropriate passage.

The refrigerating element whether an evaporator or in what ever form may include a horizontal or vertical configuration.

The air flow from the cooling compartment to the refrigerating element may be directed by a damper which may be adjustable and even thermostatically controlled.

Although the flow patterns of the air enable the defrost of the refrigerating element without undesirable cooling or defrost of the content of the refrigerator, it may be desirable to have additional means to circulate air, such as a fan.

There are conventional drip receiving means and drain means. The drip receiving means may be further adapted as part of the means to direct air from the refrigerating element to the freezing compartment and substantially enclose the refrigerating element and form part of the means to direct air from the cooling compartment to the refrigerating element and include a damper.

The means to direct air from the refrigerating element to the freezing compartment, means to direct air from freezing compartment to the refrigerating element may both include the refrigerating element spaced away over the freezing compartment and the freezing compartment open to the refrigerating element. The means to direct air from the refrigerating element to the cooling compartment may include overflow of air from the freezing compartment to the cooling compartment. The means to direct air from the cooling compartment to the refrigerating element may include flow of air from the cooling compartment directly over the refrigerating element which is open to circulation between the freezing compartment and the underside of the insulated housing of the refrigerator.

Any dampers directing the flow of air to the evaporator are within the flow of unfrozen air generally, since they are located in the cooling compartment.

Although such novel feature or features believed to be characteristic of the invention are pointed out in the claims, the invention and the manner in which it may be carried out may be further understood by reference to the description following and the accompanying drawings.

BRIEF DESCRIPTION OF THE DRAWING

FIG. 1 is a broken away side elevation of the frost-free refrigerator of the present invention with a freezing compartment within the cooling compartment.

FIG. 1*a* is a detail of FIG. 1 showing the air flow pattern during the compressor off cycle.

FIG. 2 is a schematic of the conventional compressor evaporator and condenser employable in the refrigerating cycle of the present invention.

FIG. 3 is a section of FIG. 2 at lines 3—3.

FIG. 4 is a detail of a frost-free refrigerator, such as shown in FIG. 1, including a circulating fan.

FIG. 5 is a cut-away detail of another embodiment of the frost-free refrigerator of FIG. 1, having side-by-side air passages.

FIG. 5*a* is a detail of FIG. 5 showing the air flow pattern during the compressor off cycle.

FIG. 6 is a cut-away detail front elevation of FIG. 5.

FIG. 7 is a plan view of the evaporator, passages and drip tray, of FIGS. 5.

FIG. 8 is a cut-away sectional side elevation detail of another embodiment of the frost-free refrigerator of the present invention having a freezing compartment with a separate door.

FIG. 9 is a cut-away sectional side elevation detail of another embodiment of the frost-free refrigerator of the present invention having a vertical evaporator.

FIG. 10 is a cut-away sectional front elevation detail of another embodiment of the frost-free refrigerator of the present invention including an ice cube compartment.

Referring now to the figures in greater detail, where like reference number denote like parts in the various figures.

DETAILED DESCRIPTION

The refrigerator 10, in a preferred embodiment as shown in FIGS. 1 and la comprises a conventional insulated housing 11, including an insulated door 12, a conventional compressor 13 and a conventional condenser 14. The refrigerator 10 includes a freezing compartment 15 inside the cooling compartment 25. The freezing compartment 15 has its own door 16. There is a conventional drip tray 17 with a drain 18 leading to a conventional drain pan 26, resting upon the compressor 13. The refrigerator 10 has a fixed damper 19 between the cooling compartment 25 and the drip tray 17, which controls the flow of air from the cooling compartment moving toward the refrigerating element which is illustrated as an evaporator 22.

As shown schematically in FIG. 2, the conventional cycle of the refrigerator includes the compressor 13, receiving the refrigerant fluid, compressing it and sending it through the regular tubing 21 into the condenser 14, where the compressed refrigerant is allowed to cool and liquefy. The liquid refrigerant then enters the capillary tube 20 and moves on to the evaporator 22.

The liquid, compressed refrigerant enters the evaporator 22, where it expands and boils, absorbing heat surrounding the evaporator. Heat exchange is aided by conventional fins 23 on the tubing of the evaporator 22. I the conventional refrigerating cycle, as shown in section, in FIG. 3, the compressed refrigerant fluid passes through the capillary tube 20 adjacent the regular tubing 21, so that the refrigerant leaving the evaporator 22 may be heated by the refrigerant leaving the condenser 14.

The evaporator 22 is located over the drip tray 17 at the top of the refrigerator, with access to a channel 27, divided by a shield 28.

The channel 27 is bounded by the inner wall of the insulated housing 11 and an insulated wall 29 within the cooling compartment 25. The insulated wall includes a slot 24, preferably with an upward slope, which opens to the passage 30 formed in the channel 27 by the shield 28.

As can be seen in FIG. 1, with the compressor cycle on, the warmer air from the freezing compartment 15 passes in the directions of the arrows through the passage 31 in the channel 27, passing over the evaporator 22 with its heat exchange fins 23. The air flows in the direction of the arrows, as indicated, the cooled air dropping along the drip tray 17 into the passage 30 and into the freezing compartment 15. It should be noted that part of the cooled air passes through slot 24 in the direction of the arrow, as shown, into the cooling compartment 25. Warm air from the cooling compartment 25 passes between the fixed damper 19 and the drip tray 17, so that the warm air also has access to the evaporator 22.

As shown in a detail in FIG. 4, a refrigerator 10 includes a circulating fan 32 atop the passage 31. The passages 30, 31 are further defined by the shield 38.

In FIGS. 5, 5*a* and 6, the details of another embodiment of the present invention are shown, with refrigerator 40 having side-by-side passages 41 and 42. The refrigerator 40 also includes an adjustable damper 43.

As can best be seen, in FIG. 6, the passages 41 open above the drip tray 17 and are adapted to receive the warmer air passing in the direction of arrows A from the freezing compartment 15. The cooled air passes over the evaporator 22 then enters passage 42. Passage 42 is defined by the walls of the passages 41. The cooled air passes in the direction of arrows B into the freezing compartment 15. The slot 24 opens into the passage 42 and allows passage of cooled air through the slot 24 into the cooling compartment 25, as shown b the arrows.

As shown in FIG. 5, the adjustable damper 43 is shown substantially closed during the compressor on cycle. As shown in FIG. 5*a*, the adjustable damper is shown substantially open in the compressor off cycle. It should be noted in FIG. 5*a*, that in the compressor off cycle cooler air flows substantially in the direction of arrow B through the passage 42 and into the cooling compartment 25, as indicated by the arrows with substantially no warmer air circulation from the freezing compartment 15.

In FIG. 7, the evaporator 22 can be seen over the sloped drip tray 17, leading to the drain 18.

FIG. 8 has a separate freezing compartment 51 with a separate door 53. The cooling compartment 52 has its own separate door 54. The two compartments are joined by the channel 27 with a shield 28, dividing the channel 27 into passages 30 and 31, substantially as disclosed in FIG. 1.

The refrigerator 60, as shown in FIG. 9, has a vertical evaporator 61 in the channel 27, with a drain 62 adapted to catch drippings from the bottom of the evaporator 61. There is an opening 64 into the channel 27, covered by a fixed damper 63 at the top of the cooling compartment 25. A shield 65 toward the top of the freezing compartment 15 acts as a guide to direct air into the channel 27, for directing convection to and from the freezing compartment 15.

In FIG. 10, a refrigerator 70 is shown from the front, with the door cut away. The refrigerator 70 as disclosed, has a single evaporator coil 71 with heat exchange fins 72 and drip troughs 73. There is insulation 74, defining the outside of a freezing compartment 75, generally closed by a conventional door (not shown). The freezing compartment 75, as shown, includes ice cube trays 76. The freezing compartment 75 is open at its top so that there can be a free flow of cooled air from the freezing compartment 75 into the cooling compartment 77.

The embodiment of the present invention, as shown in FIGS. 1 and 1*a*, is a preferred embodiment, in terms of economy of operation and economy of construction. In operation, with the compressor on cycle, as shown in FIG. 1, the refrigerant conventionally reaches the evaporator 22. The evaporator 22 is physically above the freezing compartment 15 toward the top of the refrigerator 10, with access to the cooling compartment 25. The evaporator 22 cools the surrounding air, which, by convection, follows the path along the drip tray 17 into the channel 27 and through the passage 30, directed by the shield 28, into the freezing compartment 15. As the cooled air passes the opening, or slot 24, in the insulated wall 29, cooled air enters the cooling compartment 25.

It is preferable that the slot 24 be narrow and have the upward slope as shown in the figures.

The upward slope in the slot 24 and its narrowness helps restrict a heavy flow of refrigerated air into the cooling compartment 25 which might otherwise, unduly cool the cooling compartment 25. The warmer air from the freezing compartment 15 is directed by the shield 28 as it leaves the freezing compartment 15 and is recirculated to the evaporator 22.

The evaporator 22, as shown, has conventional heat exchange fins 23 to improve its cooling capabilities.

A fixed damper 19 regulates access to the evaporator 22 beyond the drip tray 17 from the cooling compartment 25, accepting warm convective air from the cooling compartment 25, which is also circulated past the evaporator 22.

The door 12 is a normal refrigerator insulated door. The freezing compartment 15, with its door 16 does not require the precautionary door seal heating of the prior art to prevent its freezing shut. The insulation of the freezing compartment 15 is minimized by its being contained within the body of the cooling compartment 25, without access to the open environment, thus obviating the necessity for heavier insulation, where a freezer door is open to the environment with its heat. A freezing compartment of the prior art, with a door directly opening to the environment, generally requires some form of heating mechanism at the seal to prevent condensed moisture from freezing the door shut.

The refrigerator 10 is conventionally thermostatically controlled. When desired temperatures are reached, the compressor 13, which pumps the refrigerant through the evaporator 22 and the condenser 14, is then shut off.

FIG. 1*a* shows the refrigerator 10 during the compressor off cycle. During the compressor off cycle, warm air from the cooling compartment 25 flows by convention past the fixed damper 19 and circulates over the evaporator 22. The warm air defrosts the evaporator and is chilled in the process. The chilled air flows into the channel 27. Substantially all of the chilled air flows into the cooling compartment 25 through the slot 24. The defrost cycle continues until normal actuation of the cooling cycle by the conventional thermostatic system (not shown).

The evaporator 22 may have a slight down tilt, to insure no defrost drippage into the passages 30, 31. The defrosted moisture is guided by the drip tray 17 into the drain 18, where it is deposited in the drain pan 26, conventionally placed above the compressor 13. The normal heat of the compressor 13 assists in evaporating the moisture to the atmosphere.

The fixed damper 19 is conventionally adjusted to the normal atmospheric conditions for the location of the refrigerator 10, thus avoiding the use of more complex regulatory systems.

The freezing air in the freezing compartment 15 acts substantially as a pool, with convection substantially from the upper portion of the pool. Thus, during the defrost cycle, the warmer defrosted air tends to stay at the top of the freezing air pool and not defrost the contents of the freezing compartment 15 during the compressor 13 off cycle while the evaporator 22 is being defrosted.

By maintaining the evaporator 22 above the freezing compartment 15, isolated from both the freezing compartment 15 and the cooling compartment 25, a flow of air to the freezing compartment 15 and to the cooling compartment 25 may be maintained, maintaining the desired temperatures in the freezing compartment 15 and the cooling compartment 25 during both the compressor 13 on and off cycles without any undue defrosting in the freezing compartment 15 or overcooling in the cooling compartment 25.

As shown in FIG. 4, a circulating fan 32 may be employed to circulate the air within the system. The circulating fan 32 may be conventionally thermostatically controlled or of continuous operation during both the defrosting and cooling cycles. The power requirements of such fan are relatively small, not adding much cost to the operation of the refrigerator 10 of the present invention.

The refrigerator 40, as shown in FIGS. 5, 5*a* and 6, is substantially the same as the refrigerator 10, but provided with passages 41 and 42, which direct the flow of air during the compressor 13 off and on cycles. The passages 41 open to the freezing compartment 15 and receive the circulation of the warmer air, leaving the freezing compartment 15 and moving in the direction of the arrows A. The upper portion of the passages 41 are above the level of the opening of the central passage 42. Thus, the air cooled by the evaporator 22, moving down the area of the drip tray 17, flows directly into the freezing compartment 15, as indicated by the arrows B. The passages 41 straddle the evaporator 22, so that they do not interfere with the circulation of the cooled air passing through the passage 42. Cooled air reaches the cooling compartment 25 primarily through the slot 24, which, as can be seen in FIG. 6, is horizontal, a substantial distance across the width of the passage 42.

It should be remembered that whether in a compressor 13 off or on cycle, the air in the passage 42, or for that matter in passage 30 of the refrigerator 10 in FIG. 1, is both cooler and of higher pressure thereby than the air in the cooling compartment 25. Thus, there is a tendency for the cooled air to be drawn off through the slot 24 into the warmer cooling compartment 25.

The adjustable damper 43 may be bellows controlled. During the compressor 13 on cycle, as shown in FIG. 5, access from the cooling compartment 25 to the evaporator 22, is restricted. The bellows is sensitive to the temperature in the cooling compartment 25 and opens as temperature in the cooling compartment 25 rises. During the compressor 13 off cycle, the adjustable damper is in a wider open position, increasing the flow of the warmer air from the cooling compartment 25 in aid of accelerating the defrost of the evaporator 22.

The adjustable damper 43 is within the cooling compartment 25. There is a warm air flow of unfrozen air over the adjustable damper 43. the adjustable damper 43 is not threatened by the possibility of malfunction by freezing. The adjustable damper 43 does not have to be protected by any heating mechanism.

During the compressor 13 off cycle, as shown in FIG. 5*a*, there is little or no circulation of warmed air from the freezing compartment 15, pool of cold air while the chilled air passing over the evaporator 22, as part of the defrost cycle, moves into the passage 42 and continues to circulate through the slot 24, maintaining the temperature of the cooling compartment 25.

As can be seen in FIG. 7, the air moves through the passages 41 in the direction of arrows A and returns to the freezing compartment 15 through the passage 42 in the direction of arrow B. The drip tray 17 is sloped so that all of the defrost fluid reaches the drain 18 at a point, so that it can be properly dissipated.

The refrigerator 50, as shown in FIG. 8, operates substantially as refrigerators 10 and 40.

As shown in FIG. 8, the refrigerator 50 includes a freezing compartment 51 with a separate door 53, opening to the atmosphere. The cooling compartment 52 has its own separate door. The compressor 13 off and on cycles and circulation patterns are substantially the same as refrigerators 10 and 40. The economy of operation continues, though under some circumstances, adjustment or heating may be necessary to prevent freezing of the freezer door 53, closed.

As shown in FIG. 9, a refrigerator 60 is provided with a vertically disposed evaporator 61, usually of aluminum sandwiched material. A drain 62 is disposed beneath the bottom of the evaporator 61 adapted to receive all defrost dripping. The refrigerator 60 is provided with a fixed damper 63 and an opening 64 for the entry of warmed air from the cooling compartment 25 to enter the channel 27. A shield 65 tends to control the flow of air from the freezing compartment 15. Since the evaporator 61 is physically located above the freezing compartment 15, air in the freezing compartment 15 still maintains itself as a pool, substantially protected against defrost during the compressor 13 off cycle. Cool air in the passage 27 normally passes into the cooling compartment 25 through the slot 24, as shown in the other embodiments.

The refrigerator 70 as shown in FIG. 10, has an evaporator coil 71 with fins 72. Drip troughs 73 receive the drippings from the coil of the evaporator 71 via the fins 72. The evaporator coil 71 is arced upwards so that the side arms of its coil and the fins 72 receive the flow of defrost moisture. The freezing compartment 75 is provided with heavier insulation 74. The freezing compartment 75 has an open top and a conventional door (not shown). The freezing compartment 75 includes ice cube trays 76. The compartment is primarily designed for small freezing uses.

Circulation of the air into the cooling compartment 77 is obtained primarily from overflow of cold air from the freezing compartment 75, as shown by the arrows. During the compressor 13 off cycle in particular, the warmed air from the cooling compartment 77 circulates over the evaporator 71, defrosting the evaporator. The warmer air from the top of the cold air pool in the freezing compartment 75 still maintains itself towards the top of the cold air pool. In the particular embodiment in the refrigerator 70, there is a greater likelihood of some local defrosting of ice cubes in the upper portion of the freezing compartment 75. Such topical defrosting, though, is not of serious consequences with regard to ice cubes. Frozen articles in the lower portion of the freezing compartment 75 deeper in the pool of cold air, should not even be topically defrosted during the compressor 13 off cycle. The evaporator 71 preferably has fins 72 which draw defrost moisture to the drain troughs 73. The heavier insulation 74 protects the cooling compartment 77 from overcooling during the compression 13 on cycle. The heavier insulation 74 prevents defrost in the freezing compartment 75 from heat from the cooling compartment 77.

For better freezer performance, substantial separation between the evaporator and the frozen food compartment is recommended as well as very specific insulation around the freezer space.

The system of the present invention is equally applicable with any refrigerating element located above the freezing compartment. Refrigeration does not have to come from an evaporator, nor compressed refrigerant from a compressor. The system works from the flow pattern of air during the refrigeration on and off cycles. Thus, advanced refrigeration devices are defrostable during the off cycle in the same manner that an evaporator would be defrosted.

The terms and expressions which are employed are used as terms of description; it is recognized, though, that various modifications are possible.

It is also understood the following claims are intended to cover all of the generic and specific features of the invention herein described; and all statements of the scope of the invention which as a matter of language, might fall therebetween.

Having described certain forms of the invention in some detail, what is claimed is:

1. An energy frost free refrigerator including a freezing compartment and a cooling compartment and a single refrigerating element, said refrigerating element open to circulation of air thereover, temperature control means, said temperature control means adapted to actuate said refrigerating element to on and off cycles at selected temperatures, said refrigerating element located above said freezing compartment, said freezing compartment normally containing a pool of air at freezing temperature, said freezing compartment adapted to be accessed from above, means to direct air from said refrigerating element to said freezing compartment, means to direct air from said refrigerating element to said cooling compartment, means to direct air from said freezing compartment to said refrigerating element, means to direct air from said cooling compartment to said refrigerating element and, all said means to direct air including flow paths for the flow of air.

2. The invention of claim 1 including a compressor, wherein said refrigerating element is an evaporator, wherein said temperature control means is adapted to actuate said compressor to on and off cycles.

3. The invention of claim 1 wherein said freezing compartment is within said cooling compartment.

4. The invention of claim 3 wherein said freezing compartment includes a door.

5. The invention of claim 1 wherein said freezing compartment includes a door.

6. The invention of claim 1 wherein said means to direct air from said refrigerating element to said freezing compartment and from said refrigerating element to said cooling compartment and from said freezing compartment to said refrigerating element include a channel between said refrigerating element and said freezing compartment.

7. The invention of claim 6 including a plurality of passages in said channel.

8. The invention of claim 7 wherein said passages are defined by a shield.

9. The invention of claim 8 wherein said shield ends within said freezing compartment.

10. The invention of claim 9 wherein said shield is curved at its end.

11. The invention of claim 7 including at least one passage adapted to direct air from said refrigerating element to said freezing compartment and at least one passage adapted to direct air from said freezing compartment to said refrigerating element.

12. The invention of claim 11 wherein said at least one passage from said freezing compartment to said refrigerating element opens at a level above said at least one passage from said refrigerating element to said freezing compartment.

13. The invention of claim 6 wherein said channel includes a slot.

14. The invention of claim 13 wherein said slot is horizontal.

15. The invention of claim 14 wherein said slot opens into said cooling compartment.

16. The invention of claim 15 wherein said slot includes peripheral edges upsloped toward said cooling compartment.

17. The invention of claim 13 wherein said slot is in said means to direct air from said refrigerating element to said freezing compartment.

18. The invention of claim 17 wherein said slot is horizontal.

19. The invention of claim 18 wherein said slot opens into said cooling compartment.

20. The invention of claim 19 wherein said slot includes peripheral edges upsloped toward said cooling compartment.

21. The invention of claim 1 wherein said refrigerating element includes a horizontal configuration.

22. The invention of claim 1 wherein said refrigerating element includes a vertical configuration.

23. The invention of claim 2 wherein said evaporator includes a horizontal configuration.

24. The invention of claim 23 wherein said evaporator includes a vertical configuration.

25. The invention of claim 1 wherein said means to direct air from said cooling compartment to said refrigerating element includes a damper.

26. The invention of claim 25 wherein said damper is adjustable.

27. The invention of claim 26 wherein said adjustability is thermostatically controlled.

28. The invention of claim 1 including additional means to circulate air.

29. The invention of claim 28 wherein said additional means includes fan means.

30. The invention of claim 1 including drip receiving means and drain means.

31. The invention of claim 30 wherein said drip receiving means is further adapted as part of said means to direct air from said refrigerating element to said freezing compartment.

32. The invention of claim 30 wherein said drip receiving means substantially enclose said refrigerating element.

33. The invention of claim 32 wherein said means to direct air from said cooling compartment to said refrigerating element includes a damper.

34. The invention of claim 1 wherein said means to direct air from said refrigerating element to said freezing compartment and means to direct air from freezing compartment to said refrigerating element both include said refrigerating element spaced away over said freezing compartment, said freezing compartment open to said refrigerating element.

35. The invention of claim 34 wherein said means to direct air from said refrigerating element to said cooling compartment includes overflow of air from said freezing compartment.

36. The invention of claim 35 wherein said means to direct air from said cooling compartment to said refrigerating element includes flow of warmer air from said cooling compartment directly over said refrigerating element.

37. The invention of claim 25 including means to direct unfrozen air past said damper.

38. The invention of claim 37 wherein said damper is within said cooling compartment.

39. The invention of claim 37 wherein said damper is adjustable.

40. The invention of claim 39 wherein said adjustability is thermostatically controlled.

41. The invention of claim 34 including drip receiving means.

42. The invention of claim 41 wherein said drip receiving means include a trough.

43. An energy efficient frost free refrigerator including a freezing compartment and a cooling compartment, a single refrigerating element, temperature control means, said temperature control means adapted to actuate said refrigerating element to on and off cycles at selected temperatures, said refrigerating element located above said freezing compartment, means to direct air from said refrigerating element to said freezing compartment, means to direct air from said refrigerating element to said cooling compartment, means to direct air from said freezing compartment to said refrigerating element, means to direct air from said cooling compartment to said refrigerating element, said means to direct air from said refrigerating element to said freezing compartment and from said refrigerating element to said cooling compartment and from said freezing compartment to said refrigerating element include a channel between said refrigerating element and said freezing compartment, said channel including a plurality of passages, said passages defined by a shield, said shield ending within said freezing compartment, said shield curved at its end, at least one said passage adapted to direct air from said refrigerating element to said freezing compartment and at least one passage adapted to direct air from said freezing compartment to said refrigerating element, and said at least one passage from said freezing compartment to said refrigerating element openly at a level above said at least one passage from said refrigerating element to said freezing compartment.

* * * * *